US009722307B2

(12) United States Patent
Jiang et al.

(10) Patent No.: US 9,722,307 B2
(45) Date of Patent: Aug. 1, 2017

(54) TERMINAL ANTENNA STRUCTURE AND TERMINAL

(71) Applicant: Huawei Device Co., Ltd., Shenzhen (CN)

(72) Inventors: Lintao Jiang, Shenzhen (CN); Yi Fan, Shenzhen (CN); Yao Lan, Shenzhen (CN); Jie Qi, Shenzhen (CN)

(73) Assignee: Huawei Device Co., Ltd., Shenzhen (CN)

( * ) Notice: Subject to any disclaimer, the term of this patent is extended or adjusted under 35 U.S.C. 154(b) by 260 days.

(21) Appl. No.: 14/529,494

(22) Filed: Oct. 31, 2014

(65) Prior Publication Data

US 2015/0214601 A1 Jul. 30, 2015

Related U.S. Application Data

(63) Continuation of application No. PCT/CN2014/084581, filed on Aug. 18, 2014.

(30) Foreign Application Priority Data

Jan. 26, 2014 (CN) ..... 2014 1 0038405

(51) Int. Cl.
*H01Q 1/24* (2006.01)
*H01Q 1/50* (2006.01)
*H01P 1/00* (2006.01)

(52) U.S. Cl.
CPC *H01Q 1/50* (2013.01); *H01P 1/00* (2013.01)

(58) Field of Classification Search
CPC ..... H01Q 1/50; H01P 1/00
See application file for complete search history.

(56) References Cited

U.S. PATENT DOCUMENTS

2004/0233014 A1 11/2004 Juenemann et al.
2011/0193757 A1* 8/2011 Choi ..... H01Q 13/10 343/749
2012/0050124 A1 3/2012 Tu

FOREIGN PATENT DOCUMENTS

CN 1925223 A 3/2007
CN 101697380 A 4/2010
CN 102377019 A 3/2012
(Continued)

OTHER PUBLICATIONS

Partial English Translation and Abstract of Chinese Patent Application No. CN1925223, Part 1, Oct. 28, 2015, 4 pages.
(Continued)

*Primary Examiner* — Dieu H Duong
*Assistant Examiner* — Michael Bouizza
(74) *Attorney, Agent, or Firm* — Conley Rose, P.C.

(57) ABSTRACT

A terminal antenna structure, the antenna structure includes: a dielectric plate, a metal plate, a coplanar waveguide (CPW) feeding strip, and a feeding point, where the metal plate covers a dielectric plate; the CPW feeding strip and the feeding point are disposed on the dielectric plate; the feeding point is disposed at one end of the feeding strip, and the feeding point is connected to the metal plate to implement feed connection between the CPW feeding strip and the metal plate; a hole is opened on the metal plate, and the hole includes a first part and a second part on one side of the first part close to the center of the metal plate or on two sides of the first part.

20 Claims, 5 Drawing Sheets

(56) References Cited

FOREIGN PATENT DOCUMENTS

| | | | |
|---|---|---|---|
| CN | 103460505 | A | 12/2013 |
| CN | 103682583 | A | 3/2014 |
| JP | 05063432 | A | 3/1993 |
| JP | 2004312751 | A | 11/2004 |
| JP | 2011101327 | A | 5/2011 |
| JP | 2012227632 | A | 11/2012 |
| KR | 20080019759 | A | 3/2008 |
| WO | 2005064747 | A1 | 7/2005 |
| WO | 2010086587 | A1 | 8/2010 |
| WO | 2010086597 | A1 | 8/2010 |

OTHER PUBLICATIONS

Partial English Translation and Abstract of Chinese Patent Application No. CN1925223, Part 2, Oct. 28, 2015, 2 pages.
Partial English Translation and Abstract of Chinese Patent Application No. CN101697380, Part 1, Oct. 28, 2015, 4 pages.
Partial English Translation and Abstract of Chinese Patent Application No. CN101697380, Part 2, Oct. 28, 2015, 2 pages.
Partial English Translation and Abstract of Chinese Patent Application No. CN103460505, Part 1, Oct. 28, 2015, 7 pages.
Partial English Translation and Abstract of Chinese Patent Application No. CN103460505, Part 2, Oct. 28, 2015, 3 pages.
Foreign Communication From a Counterpart Application, European Application No. 14789501.5, Extended European Search Report dated Oct. 14, 2015, 9 pages.
Partial English Translation and Abstract of Chinese Patent Application No. CN103682583A, Dec. 17, 2014, 3 pages.
Partial English Translation and Abstract of Chinese Patent Application No. CN103682583A, Dec. 17, 2014, 2 pages.
Foreign Communication From a Counterpart Application, Chinese Application No. PCT/CN2014/084581, International Search Report dated Nov. 14, 2014, 7 pages.
Foreign Communication From a Counterpart Application, Chinese Application No. PCT/CN2014/084581, Written Opinion dated Nov. 14, 2014, 6 pages.
Foreign Communication From a Counterpart Application, Japanese Application No. 2015-558343, Japanese Notice of Allowance dated Mar. 1, 2016, 3 pages.

* cited by examiner

TERMINAL ANTENNA STRUCTURE AND TERMINAL

CROSS-REFERENCE TO RELATED APPLICATIONS

This application is a continuation of International Application No. PCT/CN2014/084581, filed on Aug. 18, 2014, which claims priority to Chinese Patent Application No. CN 201410038405.4, filed on Jan. 26, 2014, both of which are hereby incorporated by reference in their entireties.

TECHNICAL FIELD

The present invention relates to the field of communications technologies, and in particular, to a terminal antenna structure and a terminal.

BACKGROUND

With rapid development of mobile communications technologies, functions of terminal products become diversified and complicated, posing increasingly stringent requirements on terminal antennas. Nowadays, an integration level of terminal products is continuously improved, which requires that the second generation mobile communications technology (2G), the third generation mobile communications technology (3G), and the fourth generation mobile communications technology (4G), that is, Long Term Evolution (LTE), are implemented in a same terminal product at the same time, posing increasingly high requirements on bandwidth and performance of an antenna. Therefore, antennas with wide frequency bands and high efficiency are needed to meet requirements of terminal products.

Currently, 4G LTE products have been commercially used, and some terminal products also start to be required to support an LTE frequency band. Because bandwidth of the LTE frequency band (for example, 791 megahertz (MHz) to 960 MHz, 1400 MHz to 1500 MHz, or 1710 MHz to 2690 MHz) is much wider than that of the previous 2G and 3G frequency bands, conventional antennas can hardly meet the bandwidth requirement. Moreover, it is required by the LTE that efficiency of antennas cannot be too low (for example, at least 35% for a low frequency, and at least 45% for a high frequency).

Therefore, how to implement an antenna that can cover an entire LTE frequency band and has high efficiency is an urgent technical problem that a person skilled in the art needs to resolve.

SUMMARY

Embodiments of the present invention provide a terminal antenna structure and a terminal, where the antenna structure can cover an entire LTE frequency band, has high efficiency, and meets an LTE full-band performance requirement.

According to a first aspect, a terminal antenna structure is provided, where the antenna structure includes: a dielectric plate, a metal plate, a coplanar waveguide (CPW) feeding strip, and a feeding point, where the metal plate covers the dielectric plate; the CPW feeding strip and the feeding point are disposed on the dielectric plate; and the feeding point is disposed at one end of the feeding strip, and the feeding point is connected to the metal plate to implement feed connection between the CPW feeding strip and the metal plate; a hole is opened on the metal plate, the hole includes a first part and a second part, and the second part is disposed on one side of the first part close to the center of the metal plate or on two sides of the first part; and the first part is disposed at positions that are on the metal plate and are corresponding to the CPW feeding strip and the feeding point; and the second part extends along the one side or the two sides of the first part to form at least two gaps.

In a first possible implementation manner of the first aspect, a size of the first part is slightly greater than sizes of the CPW feeding strip and the feeding point.

With reference to the first aspect and the first possible implementation manner of the first aspect, in a second possible implementation manner of the first aspect, the gaps are of a polygon with M sides each, where M is an integer not less than 3.

With reference to the first aspect and either of the foregoing possible implementation manners of the first aspect, in a third possible implementation manner of the first aspect, the CPW feeding strip is parallel to or perpendicular to a long side of the dielectric plate, or an angle is set between the CPW feeding strip and the long side.

With reference to the first aspect and any one of the foregoing possible implementation manners of the first aspect, in a fourth possible implementation manner of the first aspect, the CPW feeding strip is in a straight line shape, a T shape, an L shape, an F shape, a U shape, or an E shape.

According to a second aspect, a terminal is provided, including a housing and an antenna structure, where the antenna structure is fastened in the housing, and the antenna structure includes: a dielectric plate, a metal plate, a CPW feeding strip, and a feeding point, where the metal plate covers the dielectric plate; the CPW feeding strip and the feeding point are disposed on the dielectric plate; and the feeding point is disposed at one end of the feeding strip, and the feeding point is connected to the metal plate to implement feed connection between the CPW feeding strip and the metal plate; a hole is opened on the metal plate, the hole includes a first part and a second part, and the second part is disposed on one side of the first part close to the center of the metal plate or on two sides of the first part; and the first part is disposed at positions that are on the metal plate and are corresponding to the CPW feeding strip and the feeding point; and the second part extends along the one side or the two sides of the first part to form at least two gaps.

In a first possible implementation manner of the second aspect, a size of the first part of the hole is slightly greater than sizes of the CPW feeding strip and the feeding point.

With reference to the second aspect and the first possible implementation manner of the second aspect, in a second possible implementation manner of the second aspect, the gaps are of a polygon with M sides each, where M is an integer not less than 3.

With reference to the second aspect and either of the foregoing possible implementation manners of the second aspect, in a third possible implementation manner of the second aspect, the CPW feeding strip is parallel to or perpendicular to a long side of the dielectric plate, or an angle is set between the CPW feeding strip and the long side.

With reference to the second aspect and any one of the foregoing possible implementation manners of the second aspect, in a fourth possible implementation manner of the second aspect, the CPW feeding strip is in a straight line shape, a T shape, an L shape, an F shape, a U shape, or an E shape.

Compared with the prior art, in the terminal antenna structure according to the embodiments of the present invention, the hole is opened on the metal plate, and the second part of the hole extends along one side or two sides of the first part of the hole to form at least two gaps, which form two or more gap structures distributed on one side and/or two sides of the CPW feeding strip.

In the embodiments of the present invention, the gap structures are distributed on one side or two sides of the CPW feeding strip, and the metal plate is a main radiator of the antenna structure, so that a current is excited on the CPW feeding strip and the metal plate to generate high frequency resonance. In addition, the CPW feeding strip feeds the gap structures distributed on the one side or the two sides of the CPW feeding strip to generate low frequency resonance, which implements broadband radiation, so that the gap antenna structure can cover an entire LTE frequency band. Moreover, the gap structures can improve high and low frequency performance of the gap antenna structure by loading a distribution parameter, so that the gap antenna structure has high efficiency, and meets an LTE full-band performance requirement.

BRIEF DESCRIPTION OF THE DRAWINGS

To describe the technical solutions in the embodiments of the present invention more clearly, the following briefly introduces the accompanying drawings required for describing the embodiments. The accompanying drawings in the following description show merely some embodiments of the present invention, and a person of ordinary skill in the art may still derive other drawings from these accompanying drawings without creative efforts.

DETAILED DESCRIPTION

The following clearly describes the technical solutions in the embodiments of the present invention with reference to the accompanying drawings in the embodiments of the present invention. The described embodiments are merely a part rather than all of the embodiments of the present invention. All other embodiments obtained by a person of ordinary skill in the art based on the embodiments of the present invention without creative efforts shall fall within the protection scope of the present invention.

The embodiments of the present invention provide a terminal antenna structure and a terminal, where the antenna structure can cover an entire LTE frequency band, has high efficiency, and meets an LTE full-band performance requirement.

The terms used in the embodiments of the present invention are merely for the purpose of illustrating specific embodiments, and are not intended to limit the present invention. The terms "a", "said", and "the" of singular forms used in the embodiments and the appended claims of the present invention are also intended to include plural forms, unless otherwise specified in the context clearly. It should also be understood that, the term "and/or" used herein indicates and includes any or all possible combinations of one or more associated listed items.

Figure 1:
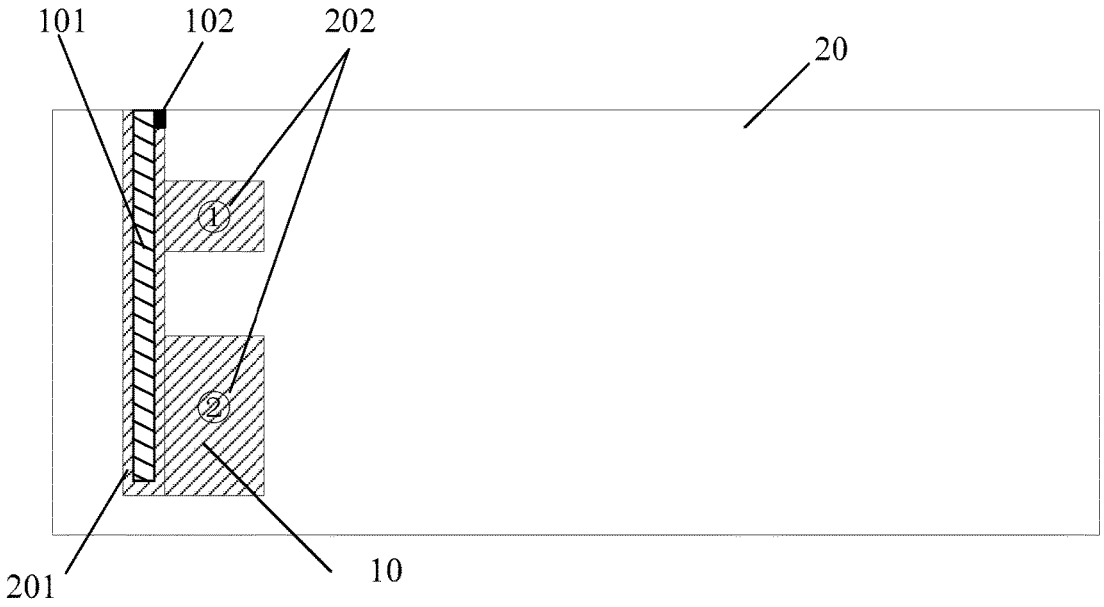
FIG. 1 is a structural diagram of a terminal antenna according to Embodiment 1 of the present invention.

Referring to FIG. 1, FIG. 1 is a structural diagram of a terminal antenna according to Embodiment 1 of the present invention. As shown in FIG. 1, a structure of the antenna includes a dielectric plate 10, a metal plate 20, a CPW feeding strip 101, and a feeding point 102.

The metal plate 20 covers the dielectric plate 10. Specifically, the metal plate 20 is disposed on the dielectric plate 10 to cover the dielectric plate 10.

The CPW feeding strip 101 and the feeding point 102 are disposed on the dielectric plate 10; and the feeding point 102 is disposed at one end of the feeding strip 101, and the feeding point 102 is connected to the metal plate 20 to implement feed connection between the CPW feeding strip 101 and the metal plate 20.

A hole is opened on the metal plate 20. The hole includes a first part 201 and a second part 202 on one side of the first part 201 close to the center of the metal plate 20 or on two sides of the first part 201.

The first part 201 is disposed at positions that are on the metal plate 20 and are corresponding to the CPW feeding strip 101 and the feeding point 102; and the second part 202 extends along the one side or the two sides of the first part 201 to form at least two gaps.

With reference to FIG. 1, the first part 201 of the hole faces positions of the CPW feeding strip 101 and the feeding point 102. A size of the first part 201 of the hole is slightly greater than sizes of the CPW feeding strip 101 and the feeding point 102, so that the CPW feeding strip 101 and the feeding point 102 that are disposed on the dielectric plate 10 completely pass through the metal plate 20 via the first part 201 and are exposed.

As shown in FIG. 1, in the structure of the antenna according to Embodiment 1 of the present invention, the second part 202 of the hole is located on one side of the first part 201 close to the center of the metal plate 20, so that the second part 202 extends along the one side of the first part 201 to form at least two gaps. Specifically, at least two gaps are formed on one side or two sides of the CPW feeding strip 101 by using the second part 202.

It should be noted that, the first part 201 and the second part 202 of the hole are connected.

With reference to FIG. 1, on the metal plate 20, the second part 202 of the hole is located on one side of the first part 201, and specifically, the second part 202 forms two rectangular notches, as shown in areas marked by (1) and (2) in FIG. 1. The CPW feeding strip 101 and the feeding point 102 that are disposed on the dielectric plate 10 pass through the metal plate 20 via the first part 201 of the hole and are exposed. Then, parts obtained by mapping the two notches onto the dielectric plate 10 are also exposed by using the two notches formed by the second part 202 disposed on one side of the first part 201. Moreover, after the two notches are cut, two gaps are formed between the remaining part on the metal plate 20 and the CPW feeding strip 101, which are respectively marked by (1) and (2) in FIG. 1.

It should be noted that, with reference to FIG. 1, areas marked by slashes in FIG. 1 represent the dielectric plate 10 and the CPW feeding strip 101 that are exposed, and the other part of the dielectric plate 10 is blocked by the metal plate 20, and is not shown in FIG. 1.

It should be noted that, the metal plate 20 is a conducting plane. The conducting plane may be made of a conductor with good connectivity, such as a copper sheet or copper foil. Therefore, the conducting plane is used as a ground plane, ground for short, of the gap antenna.

It should be noted that, in a practical application, the second part 202 of the hole may also be located on two sides of the first part 201, so that the second part 202 extends along the two sides of the first part 201 to form at least two gaps.

Further, the number of gaps formed by the second part 202 extending along the one side or the two sides of the first part 201 may be specifically set as required. For example, more than two gaps, for example, three, four, or even more, may be formed.

Figure 2:
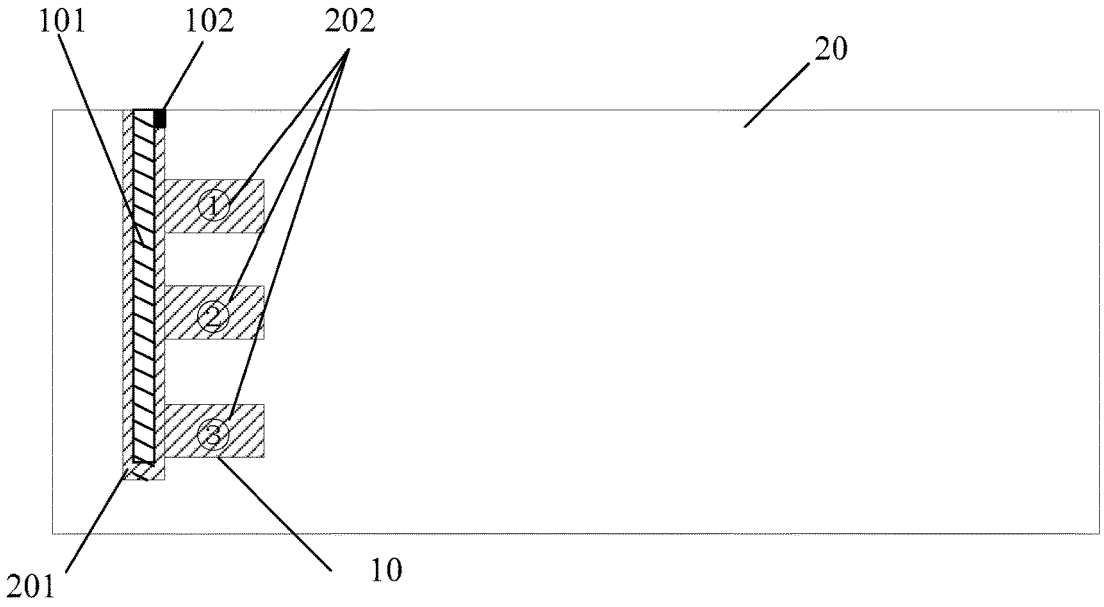
FIG. 2 is a structural diagram of a terminal antenna according to Embodiment 2 of the present invention.

Referring to FIG. 2, FIG. 2 is a structural diagram of a terminal antenna according to Embodiment 2 of the present invention. An example in which three gaps (as shown in areas marked by (1), (2), and (3) in FIG. 2) are formed on one side of a CPW feeding strip 101 is used for description in FIG. 2.

In a practical application, the number of gaps formed on one side or two sides of the CPW feeding strip 101 may be specifically set as required, which is not specifically limited by a structure of the terminal antenna according to this embodiment of the present invention. It should be noted that, each gap structure is corresponding to a wavelength, and increasing the number of gaps can increase the number of low frequency resonance points of the structure of the terminal antenna. In other words, a greater number of gaps indicates a lower resonance frequency of the structure of the terminal antenna, and wider bandwidth that can be implemented by the structure of the terminal antenna. However, because a size of an antenna is limited, the number of gaps cannot be infinitely increased, and therefore a balance point needs to be found in actual setting, and the number of desired gaps is properly set as required.

For the structure of the terminal antenna shown in FIG. 1, the structure of the antenna may be fastened in a housing of a terminal, receives energy sent by the terminal, transmits the energy to the metal plate 20, and transmits the energy to the CPW feeding strip 101 by using the feeding point 102, implementing feeding of the structure of the terminal antenna.

In this embodiment of the present invention, the structure of the terminal antenna uses a CPW feeding form plus a gap structure, because, first the CPW feeding form has a broadband feature, and second in a layout of a data card antenna, a size of a terminal antenna using the CPW feeding form can be effectively reduced.

For the gap structures shown in FIG. 1, the gaps are distributed on a same side of the CPW feeding strip 101, and mainly function to improve high and low frequency performance of the terminal antenna in a manner of loading a distribution parameter. A gap close to the feeding point 102 is mainly used to tune the high frequency performance of the terminal antenna, and a gap close to a tail end of the CPW feeding strip 101 is mainly used to tune the low frequency performance of the terminal antenna. Therefore, by opening notches on one side of the CPW feeding strip 101, two or more gaps are formed and used cooperatively, so that the gap antenna can have relatively wide bandwidth.

Specifically, in this embodiment of the present invention, on the metal plate 20, the hole is opened on the metal plate 20, and the second part of the hole forms two or more gap structures distributed on one side of the CPW feeding strip 101. In Embodiment 1 of the present invention, the gap structures are distributed on one side of the CPW feeding strip 101, and the metal plate 20 is a main radiator of the terminal antenna, so that the CPW feeding strip 101 excites a current on peripheral metal (that is, the metal plate 20) to generate high frequency resonance. In addition, the CPW feeding strip 101 feeds the gap structures distributed on one side of the CPW feeding strip 101, to generate low frequency resonance, which implements broadband radiation, so that the terminal antenna can cover the entire LTE frequency band. Moreover, the gap structures can improve the high and low frequency performance of the terminal antenna by loading a distribution parameter, so that the terminal antenna has high efficiency, and meets an LTE full-band performance requirement.

Figure 3:
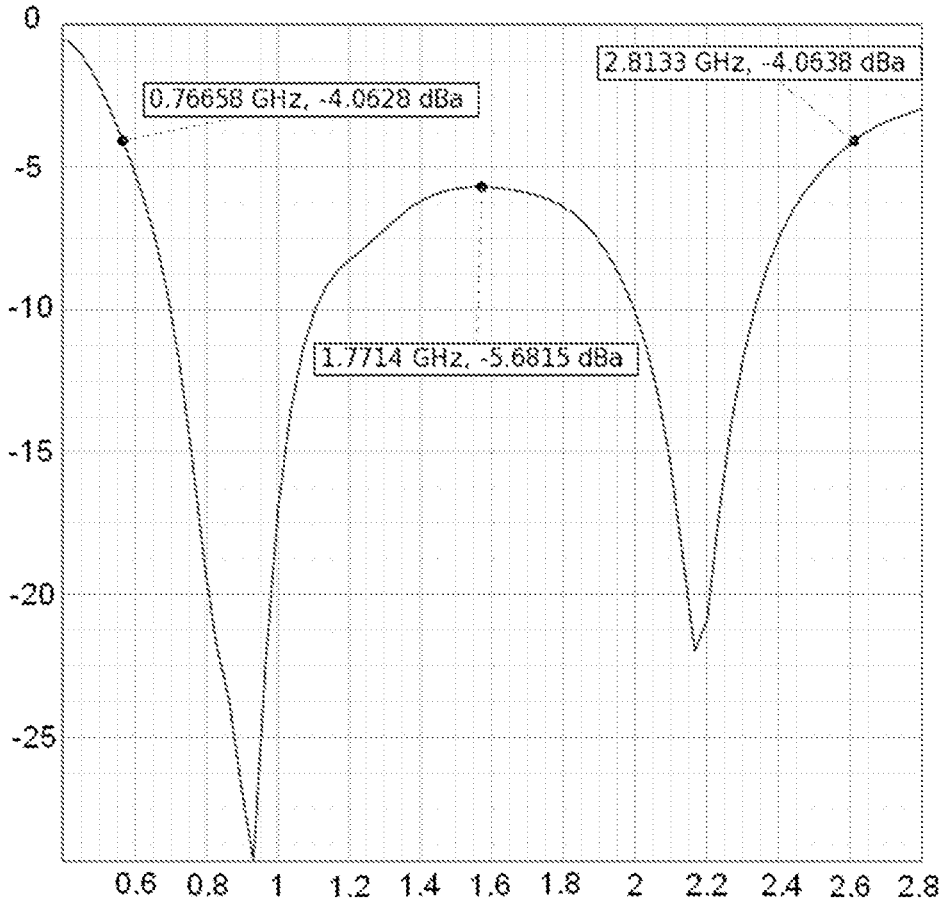
FIG. 3 is a line graph of port reflection coefficients that are obtained by emulating a structure of the terminal antenna shown in FIG. 1.

Referring to FIG. 3, FIG. 3 is a line graph of port reflection coefficients that are obtained by emulating a structure of the terminal antenna shown in FIG. 1. As shown in FIG. 3, the horizontal axis of FIG. 3 represents an operating frequency band (a unit is gigahertz (GHz)) of the structure of the terminal antenna, and the vertical axis of FIG. 3 represents a port reflection coefficient (a unit is decibel ampere (dBa)) of the structure of the terminal antenna. In a practical application, generally, if a port reflection coefficient of the structure of the terminal antenna in a specific operating frequency band is less than −4 dBa, it is considered that the structure of the terminal antenna meets a performance requirement in the operating frequency band.

With reference to FIG. 3, it can be seen that, the structure of the terminal antenna according to Embodiment 1 of the present invention can meet, in an entire LTE operating frequency band range, a requirement that the port reflection coefficient be less than −4 dBa. It can be seen from that, it can be proved in an emulation manner that the structure of the terminal antenna in this embodiment of the present invention can implement broadband radiation, covers the entire LTE frequency band (791 MHz to 2690 MHz), has high efficiency, and meets the LTE full-band performance requirement.

Further, an example in which the second part 202 is a rectangular notch to form a rectangular gap is used to describe the foregoing Embodiment 1 and Embodiment 2. In a practical application, a specific shape of a gap formed by the second part 202 does not need to be limited, and may be specifically determined as required.

Figure 4:
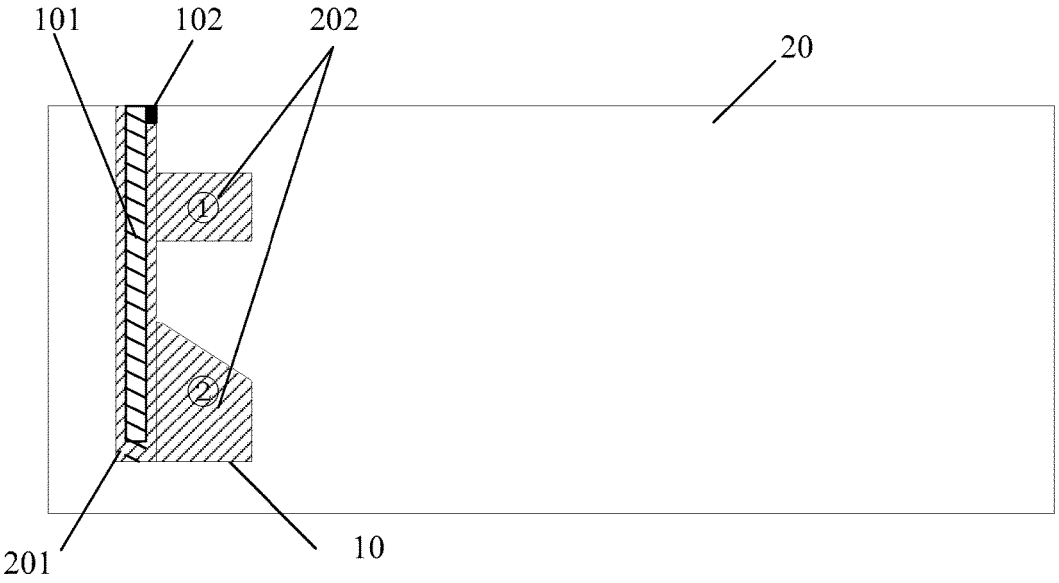
FIG. 4 is a structural diagram of a terminal antenna according to Embodiment 3 of the present invention.

Referring to FIG. 4, FIG. 4 is a structural diagram of a terminal antenna according to Embodiment 3 of the present invention. As shown in FIG. 4, a gap that is formed by a second part 202 and is close to a position of a tail end of a CPW feeding strip 101 is in a trapezoid shape. Certainly, in other embodiments of the present invention, the gap may also be in a triangle shape, in a circular shape, a polygonal shape, or the like. Specifically, by setting a shape of the second part 202, the gap may be of a polygon with M sides, where M is an integer not less than 3.

Further, in the foregoing embodiment, the CPW feeding strip 101 is a microstrip with a uniform width. In other embodiments of the present invention, the width of the CPW feeding strip 101 may be not uniform.

Specifically, the CPW feeding strip 101 may include at least one combination of metal wires, where each of the metal wires may be of any polygon with N sides, where N is an integer not less than 3.

For example, the CPW feeding strip 101 may include a rectangular metal wire and a hexagon metal wire, and the CPW feeding strip 101 is formed by combining the rectangular metal wire and the hexagon metal wire.

It should be noted that, the CPW feeding strip 101 may be formed by connecting at least one metal wire in order.

Figure 5:
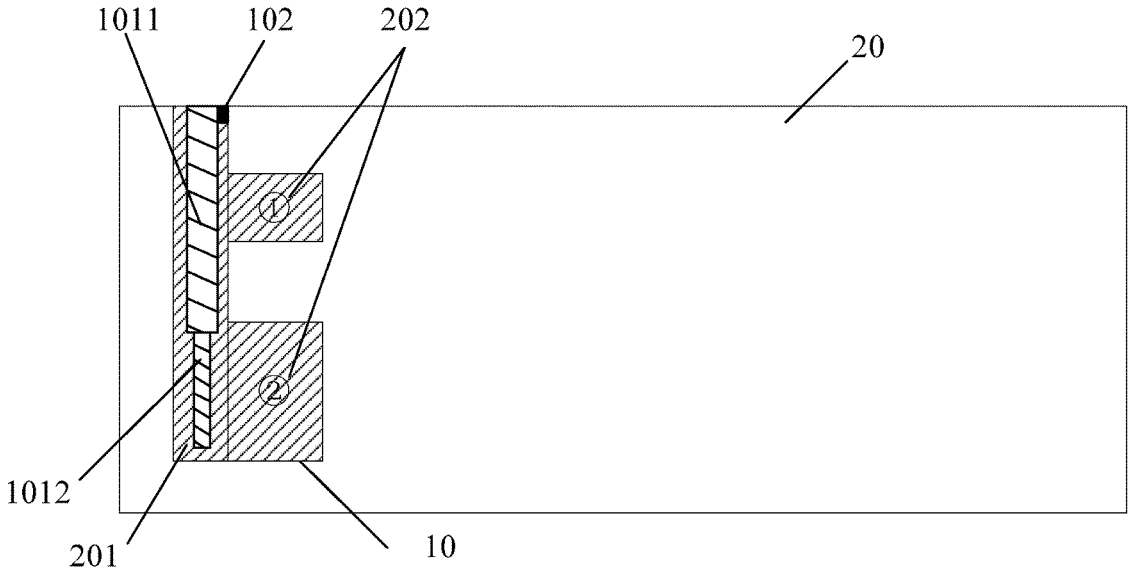
FIG. 5 is a structural diagram of a terminal antenna according to Embodiment 4 of the present invention.

Referring to FIG. 5, FIG. 5 is a structural diagram of a terminal antenna according to Embodiment 4 of the present invention. As shown in FIG. 5, a CPW feeding strip 101 includes a first metal wire 1011 and a second metal wire 1012. The first metal wire 1011 is connected to the second metal wire 1012, and a width of the first metal wire 1011 is different from that of the second metal wire 1012.

Certainly, FIG. 5 shows only an example. In other embodiments of the present invention, the CPW feeding strip 101 may be formed by connecting at least two feeding strips in order, and widths of the at least two feeding strips are not completely the same or shapes of the at least two feeding strips are not completely the same. By changing the width of the CPW feeding strip 101, an impedance feature of the terminal antenna can be adjusted, thereby adjusting an operating frequency of the terminal antenna.

Further, in the foregoing embodiment, the second part 202 is located on one side of the first part 201 close to the center of the metal plate 20, thereby forming two or more gap structures on one side of the CPW feeding strip 101. In a practical application, the second part 202 may also be located on two sides of the first part 201, thereby forming gap structures on two sides of the CPW feeding strip 101.

Figure 6:
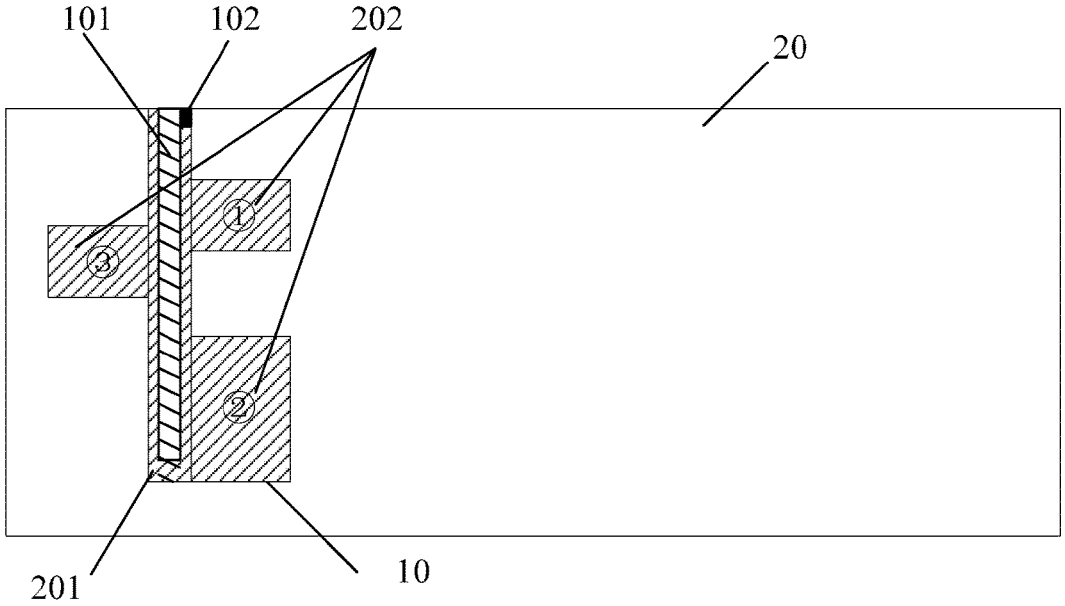
FIG. 6 is a structural diagram of a terminal antenna according to Embodiment 5 of the present invention.

Referring to FIG. 6, FIG. 6 is a structural diagram of a terminal antenna according to Embodiment 5 of the present invention. As shown in FIG. 6, a second part 202 is located on two sides of a first part 201, so that the second part 202 extends along the two sides of the first part 201 to form at least two gaps.

Specifically, as shown in FIG. 6, by using the second part 202, gap structures (as shown in areas marked by (1), (2), and (3) in FIG. 6) are formed on two sides of a CPW feeding strip 101.

It should be noted that, in Embodiment 1 shown in FIG. 1, for the CPW feeding strip 101, gap structures are formed on one side on which the feeding point 102 is disposed. In other embodiments of the present invention, for the CPW feeding strip 101, the gap structures may also be formed on an opposite side of the feeding point 102 (that is, one side on which the feeding point 102 is not disposed). Certainly, in other embodiments, the gap structures may also be formed on both sides of the CPW feeding strip 101. Moreover, the number of gaps formed on each side does not need to be limited, and may be specifically set as required. A position of a gap, that is, on which side of the CPW feeding strip 101 the gap is disposed, may be specifically set as required, and is generally determined according to a shape and an overall size of a structure of the terminal antenna.

Further, in the foregoing embodiment, the CPW feeding strip 101 is in a straight line shape. In other embodiments of the present invention, a shape of the CPW feeding strip 101 may be varied.

Figure 7:
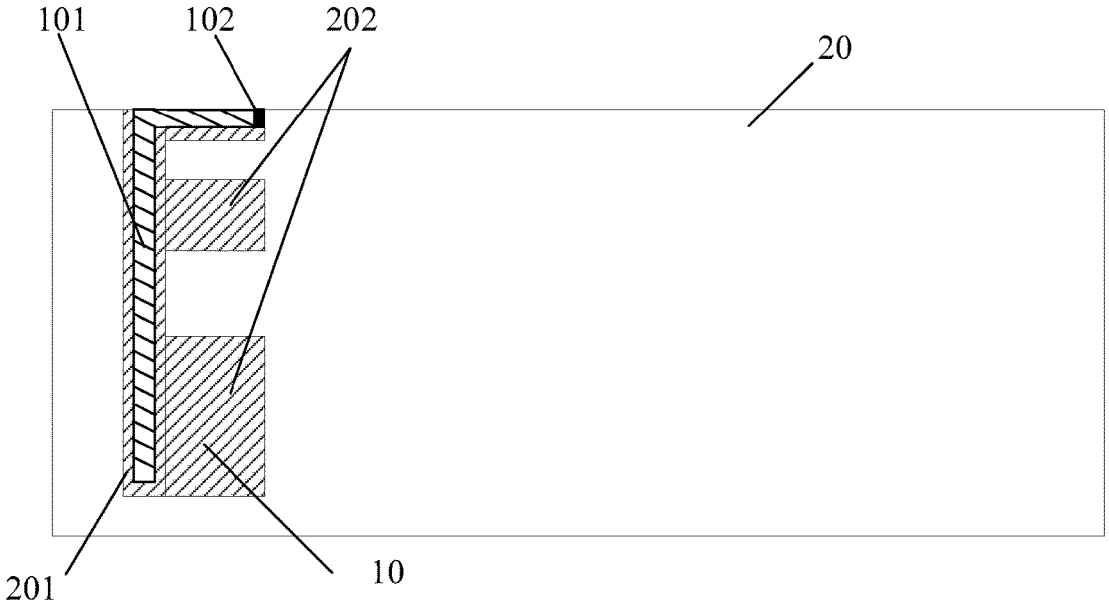
FIG. 7 is a structural diagram of a terminal antenna according to Embodiment 6 of the present invention.
Figure 8:
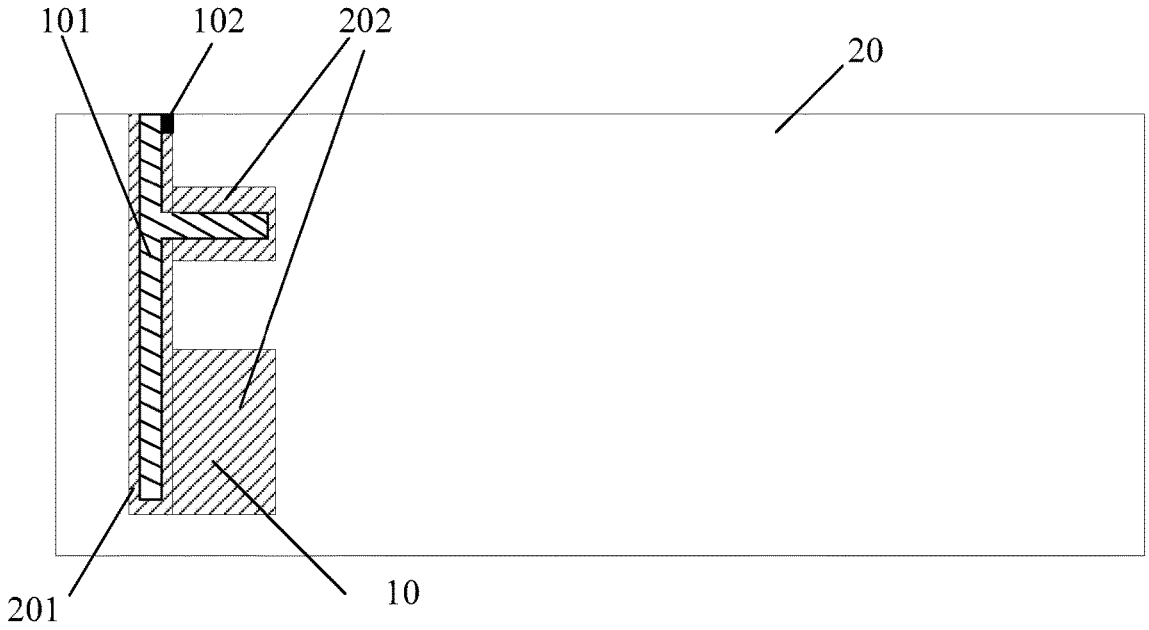
FIG. 8 is a structural diagram of a terminal antenna according to Embodiment 7 of the present invention.

Referring to FIG. 7 and FIG. 8, FIG. 7 and FIG. 8 are respectively structural diagrams of terminal antennas according to Embodiment 6 and Embodiment 7 of the present invention. As shown in FIG. 7, in Embodiment 6, a tuning stub is added to a top end of a CPW feeding strip 101 to form a bending shape (or an L shape) structure. As shown in FIG. 8, in Embodiment 7, a tuning stub is added to the middle of a CPW feeding strip 101 to form a T shape structure. In Embodiment 6 and Embodiment 7, by adding a tuning stub to the CPW feeding strip 101, a middle frequency band of a structure of the terminal antenna can be effectively improved, implementing a wide frequency band of the structure of the terminal antenna.

Certainly, Embodiment 6 and Embodiment 7 only provide two specific variant structures of the CPW feeding strip 101. In other embodiments of the present invention, the CPW feeding strip 101 may also have other variants, for example, in an F shape or an E shape, which is not specifically limited in this embodiment of the present invention.

Figure 9:
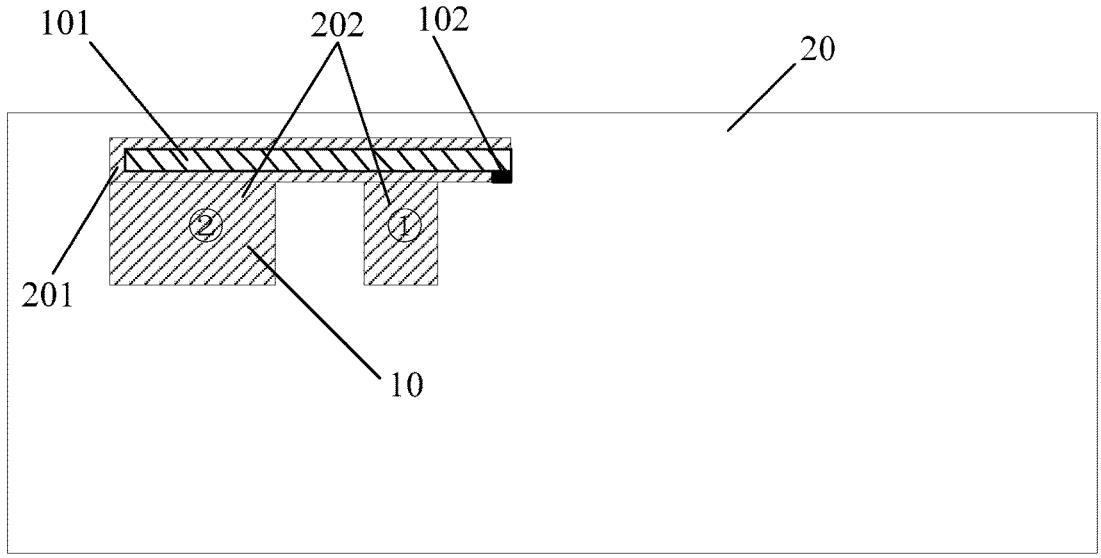
FIG. 9 is a structural diagram of a terminal antenna according to Embodiment 8 of the present invention.

Further, in the foregoing embodiments, the feeding strip 101 is perpendicular to a long side of the dielectric plate 10 and is disposed on the dielectric plate 10. In other embodiments of the present invention, a position and a setting direction of the feeding strip 101 are not limited. Referring to FIG. 9, FIG. 9 is a structural diagram of a terminal antenna according to Embodiment 8 of the present invention. As shown in FIG. 9, a feeding strip 101 is parallel to a long side of a dielectric plate 10 and is disposed on the dielectric plate 10. Certainly, in a practical application, an angle may also be set between the feeding strip 101 and the long side of the dielectric plate 10, and the feeding strip 101 is disposed on the dielectric plate 10.

Corresponding to the terminal antennas in the foregoing embodiments, an embodiment of the present invention further provides a terminal, where the terminal includes a housing and an antenna structure, and the antenna structure is fastened in the housing. The antenna structure includes a dielectric plate, a metal plate, a CPW feeding strip, and a feeding point. The metal plate covers the dielectric plate.

The CPW feeding strip and the feeding point are disposed on the dielectric plate; and the feeding point is disposed at one end of the feeding strip, and the feeding point is connected to the metal plate to implement feed connection between the CPW feeding strip and the metal plate.

A hole is opened on the metal plate, and the hole includes a first part and a second part disposed on one side of the first part close to the center of the metal plate or extending on two sides of the first part.

The first part is disposed at positions that are on the metal plate and are corresponding to the CPW feeding strip and the feeding point; and the second part extends along the one side or the two sides of the first part to form at least two gaps.

Preferably, a size of the first part of the hole is slightly greater than sizes of the CPW feeding strip and the feeding point.

Preferably, the gaps are of a polygon with M sides each, where M is an integer not less than 3.

Preferably, the CPW feeding strip is parallel to or perpendicular to a long side of the dielectric plate, or an angle is set between the CPW feeding strip and the long side.

Preferably, the CPW feeding strip is in a straight line shape, a T shape, an L shape, an F shape, a U shape, or an E shape.

The foregoing descriptions are merely specific implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A terminal antenna structure, comprising:

a dielectric plate;

a metal plate;

a coplanar waveguide (CPW) feeding strip; and a feeding point, wherein the metal plate is disposed on the dielectric plate, wherein the CPW feeding strip and the feeding point are disposed on the dielectric plate, wherein one end of the feeding point is connected to one end of the CPW feeding strip, and the other end of the feeding point is connected to the metal plate to implement feed connection between the CPW feeding strip and the metal plate, wherein the feeding point is located at an outer edge of the dielectric plate, wherein a hole is opened on the metal plate, wherein the hole is disposed at a position on the metal plate that corresponds to the CPW feeding strip and the feeding point, and wherein one or more additional holes are opened on the metal plate, wherein the one or more additional holes extend along one or more sides of the hole, wherein the one or more additional holes form one or more gaps in the metal plate, and wherein the one or more gaps in the metal plate are located at an interior portion of the metal plate such that the one or more gaps do not touch an outer edge of the metal plate.

2. The terminal antenna structure according to claim 1, wherein a size of the hole is greater than sizes of the CPW feeding strip and the feeding point.

3. The terminal antenna structure according to claim 2, wherein the one or more gaps are of a polygon with M sides each, and wherein M is an integer not less than 3.

4. The terminal antenna structure according to claim 3, wherein the dielectric plate has a long side and a short side, and wherein the CPW feeding strip is parallel to the long side of the dielectric plate.

5. The terminal antenna structure according to claim 3, wherein the dielectric plate has a long side and a short side, and wherein the CPW feeding strip is perpendicular to the long side of the dielectric plate.

6. The terminal antenna structure according to claim 3, wherein the dielectric plate has a long side and a short side, and wherein an angle less than ninety degrees is set between the CPW feeding strip and the long side of the dielectric plate.

7. The terminal antenna structure according to claim 1, wherein the one or more gaps are of a polygon with M sides each, and wherein M is an integer not less than 3.

8. The terminal antenna structure according to claim 1, wherein the dielectric plate has a long side and a short side, and wherein the CPW feeding strip is parallel to the long side of the dielectric plate.

9. The terminal antenna structure according to claim 1, wherein the dielectric plate has a long side and a short side, and wherein the CPW feeding strip is perpendicular to the long side of the dielectric plate.

10. The terminal antenna structure according to claim 1, wherein the dielectric plate has a long side and a short side, and wherein an angle less than ninety degrees is set between the CPW feeding strip and the long side.

11. The terminal antenna structure according to claim 1, wherein the CPW feeding strip is in a straight line shape, a T shape, an L shape, an F shape, a U shape, or an E shape.

12. The terminal antenna structure according to claim 1, wherein the CPW feeding strip is in a straight line shape.

13. A terminal, comprising:

a housing; and an antenna structure, wherein the antenna structure is fastened in the housing, wherein the antenna structure comprises a dielectric plate, a metal plate, a coplanar waveguide (CPW) feeding strip, and a feeding point, wherein the metal plate is disposed on the dielectric plate, wherein the CPW feeding strip and the feeding point are disposed on the dielectric plate, wherein one end of the feeding point is connected to one end of the CPW feeding strip, and the other end of the feeding point is connected to the metal plate to implement feed connection between the CPW feeding strip and the metal plate, wherein the feeding point is located at an outer edge of the dielectric plate, wherein a hole is opened on the metal plate, wherein the hole is disposed at a position on the metal plate that corresponds to the CPW feeding strip and the feeding point, wherein one or more additional holes are opened on the metal plate, wherein the one or more additional holes extend along one or more sides of the hole, wherein the one or more additional holes form one or more gaps in the metal plate, and wherein the one or more gaps in the metal plate are located at an interior portion of the metal plate such that the one or more gaps do not touch an outer edge of the metal plate.

14. The terminal according to claim 13, wherein a size of the hole is greater than sizes of the CPW feeding strip and the feeding point.

15. The terminal according to claim 13, wherein the CPW feeding strip is in a straight line shape, a T shape, an L shape, an F shape, a U shape, or an E shape.

16. The terminal according to claim 13, wherein the one or more gaps are of a polygon with M sides each, and wherein M is an integer not less than 3.

17. The terminal according to claim 13, wherein the dielectric plate has a long side and a short side, and wherein the CPW feeding strip is parallel to the long side of the dielectric plate.

18. The terminal according to claim 13, wherein the dielectric plate has a long side and a short side, and wherein the CPW feeding strip is perpendicular to the long side of the dielectric plate.

19. The terminal according to claim 13, wherein the dielectric plate has a long side and a short side, and wherein an angle less than ninety degrees is set between the CPW feeding strip and the long side.

20. The terminal according to claim 13, wherein the CPW feeding strip is in a straight line shape.

* * * * *